US011530582B2

(12) United States Patent
Ali et al.

(10) Patent No.: US 11,530,582 B2
(45) Date of Patent: Dec. 20, 2022

(54) CASING STRINGS AND RELATED METHODS OF DEPLOYMENT IN HORIZONTAL WELLS

(71) Applicant: Saudi Arabian Oil Company, Dhahran (SA)

(72) Inventors: Syed Muhammad Ali, Abqaiq (SA); Victor Jose Bustamante Rodriguez, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/245,241

(22) Filed: Apr. 30, 2021

(65) Prior Publication Data

US 2022/0349269 A1 Nov. 3, 2022

(51) Int. Cl.

| | |
|---|---|
| ***E21B 7/20*** | (2006.01) |
| ***E21B 21/08*** | (2006.01) |
| ***E21B 17/16*** | (2006.01) |
| ***E21B 17/14*** | (2006.01) |
| ***E21B 17/08*** | (2006.01) |

(52) U.S. Cl.
CPC ..... *E21B 21/08* (2013.01); *E21B 17/08* (2013.01); *E21B 17/14* (2013.01); *E21B 17/16* (2013.01)

(58) Field of Classification Search
CPC ..... E21B 43/10; E21B 7/20
See application file for complete search history.

(56) References Cited

U.S. PATENT DOCUMENTS

| | | | | |
|---|---|---|---|---|
| 1,746,132 | A * | 2/1930 | Stokes | E21B 17/00 138/148 |
| 3,398,794 | A * | 8/1968 | Fox, Jr. | E21B 43/10 166/67 |
| 4,308,917 | A * | 1/1982 | Dismukes | E21B 43/10 166/242.1 |
| 4,986,361 | A | 1/1991 | Mueller et al. | |
| 5,117,915 | A | 6/1992 | Mueller et al. | |
| 5,181,571 | A * | 1/1993 | Mueller | E21B 7/04 166/381 |
| 5,713,423 | A * | 2/1998 | Martin | E21B 17/00 166/242.3 |
| 6,505,685 | B1 | 1/2003 | Sullaway et al. | |
| 6,758,281 | B2 | 7/2004 | Sullaway et al. | |
| 7,013,997 | B2 | 3/2006 | Vail | |
| 7,413,020 | B2 * | 8/2008 | Carter | E21B 7/20 166/380 |
| 9,074,455 | B2 | 7/2015 | Pilgrim et al. | |
| 2003/0070815 | A1 | 4/2003 | Sullaway et al. | |
| 2003/0070816 | A1 * | 4/2003 | Sullaway | E21B 43/10 166/380 |
| 2003/0116324 | A1 * | 6/2003 | Dawson | E21B 43/305 166/380 |
| 2006/0027360 | A1 | 2/2006 | Basso | |

(Continued)

*Primary Examiner* — Kipp C Wallace
(74) *Attorney, Agent, or Firm* — Fish & Richardson P.C.

(57) ABSTRACT

A casing string includes an uphole section, a downhole section, and a sealed chamber that is fluidically isolated from the uphole and downhole sections. The sealed chamber extends between the uphole and downhole sections. The casing string further includes a tube that is disposed within the sealed chamber and that fluidically connects the uphole and downhole sections to provide a fluid flow path that extends past the sealed chamber and through the casing string.

16 Claims, 2 Drawing Sheets

(56) References Cited

U.S. PATENT DOCUMENTS

| | | | | |
|---|---|---|---|---|
| 2014/0216756 | A1 | 8/2014 | Getzlaf et al. | |
| 2014/0338896 | A1* | 11/2014 | McGarian | E21B 47/005 166/250.08 |
| 2017/0138153 | A1 | 5/2017 | Getzlaf et al. | |

* cited by examiner

CASING STRINGS AND RELATED METHODS OF DEPLOYMENT IN HORIZONTAL WELLS

TECHNICAL FIELD

This disclosure relates to casing strings that permit mud circulation while being run in a horizontal section.

BACKGROUND

During deployment of a long casing string in deviated or horizontal well, the casing string may need to be floated in order to overcome a drag force that is exerted against the casing string by any mud present within the well and to ultimately locate the casing string at a target depth within the well. In some examples, an air chamber or relatively lightweight fluid may be used in a downhole section of the casing string in an attempt to provide buoyancy. However, in these cases, mud cannot be circulated through the casing string until the casing string reaches a bottomhole end of the well because of the presence of the air chamber. Furthermore, other challenges may be encountered while deploying the casing string to the bottomhole end of such a well. For example, the casing string may encounter a flow obstruction that must be cleared or encounter an excessive gel strength of mud in a surrounding annulus that may render a bottomhole end of the surrounding formation susceptible to fracture.

SUMMARY

This disclosure relates to casing strings that permit mud circulation while being run in a horizontal section. To this end, a casing string includes an air chamber that provides buoyancy to a downhole section of the casing string, as well as a fiberglass tubing that passes through the air chamber to provide a circulation flow path through the casing string.

In one aspect, a casing string includes an uphole section, a downhole section, and a sealed chamber that is fluidically isolated from the uphole and downhole sections. The sealed chamber extends between the uphole and downhole sections. The casing string further includes a tube that is disposed within the sealed chamber and that fluidically connects the uphole and downhole sections to provide a fluid flow path that extends past the sealed chamber and through the casing string.

Embodiments may provide one or more of the following features.

In some embodiments, the tube includes fiber glass.

In some embodiments, the casing string is configured to permit filling of the uphole and downhole sections with drilling mud.

In some embodiments, the sealed chamber includes a fluid that is less dense than drilling mud.

In some embodiments, the sealed chamber includes air.

In some embodiments, the uphole section includes multiple uphole casing joints and a chamber collar.

In some embodiments, the downhole section includes multiple downhole casing joints and a float collar.

In some embodiments, the tube extends between the chamber collar and the float collar.

In some embodiments, the tube includes a stinger, and the float collar is a stab-in float collar.

In some embodiments, the downhole section further includes a float shoe.

In another aspect, a method of deploying a casing string within a well includes flowing drilling mud into an uphole section of the casing string and flowing the drilling mud from the uphole section into a downhole section of the casing string past a sealed chamber that is fluidically isolated from the uphole and downhole sections and that extends between the uphole and downhole sections.

Embodiments may provide one or more of the following features.

In some embodiments, the method further includes flowing the drilling mud through a tube that is disposed within the sealed chamber and that fluidically connects the uphole and downhole sections.

In some embodiments, the method further includes flowing the drilling mud out of the casing string and circulating the drilling mud through an annulus disposed between the casing string and the well.

In some embodiments, the tube includes fiber glass.

In some embodiments, the method further includes installing the tube to the casing string to fluidically connect the uphole and downhole sections after forming the sealed chamber.

In some embodiments, the sealed chamber includes a fluid that is less dense than drilling mud.

In some embodiments, the sealed chamber includes air.

In some embodiments, the well includes a substantially horizontal section, and the method further includes floating the casing string within the horizontal section of the well.

In some embodiments, the uphole section includes multiple uphole casing joints and a chamber collar, and the downhole section includes multiple downhole casing joints and a float collar.

In some embodiments, the tube extends between the chamber collar and the float collar.

The details of one or more embodiments are set forth in the accompanying drawings and description. Other features, aspects, and advantages of the embodiments will become apparent from the description, drawings, and claims.

DETAILED DESCRIPTION

Figure 1:
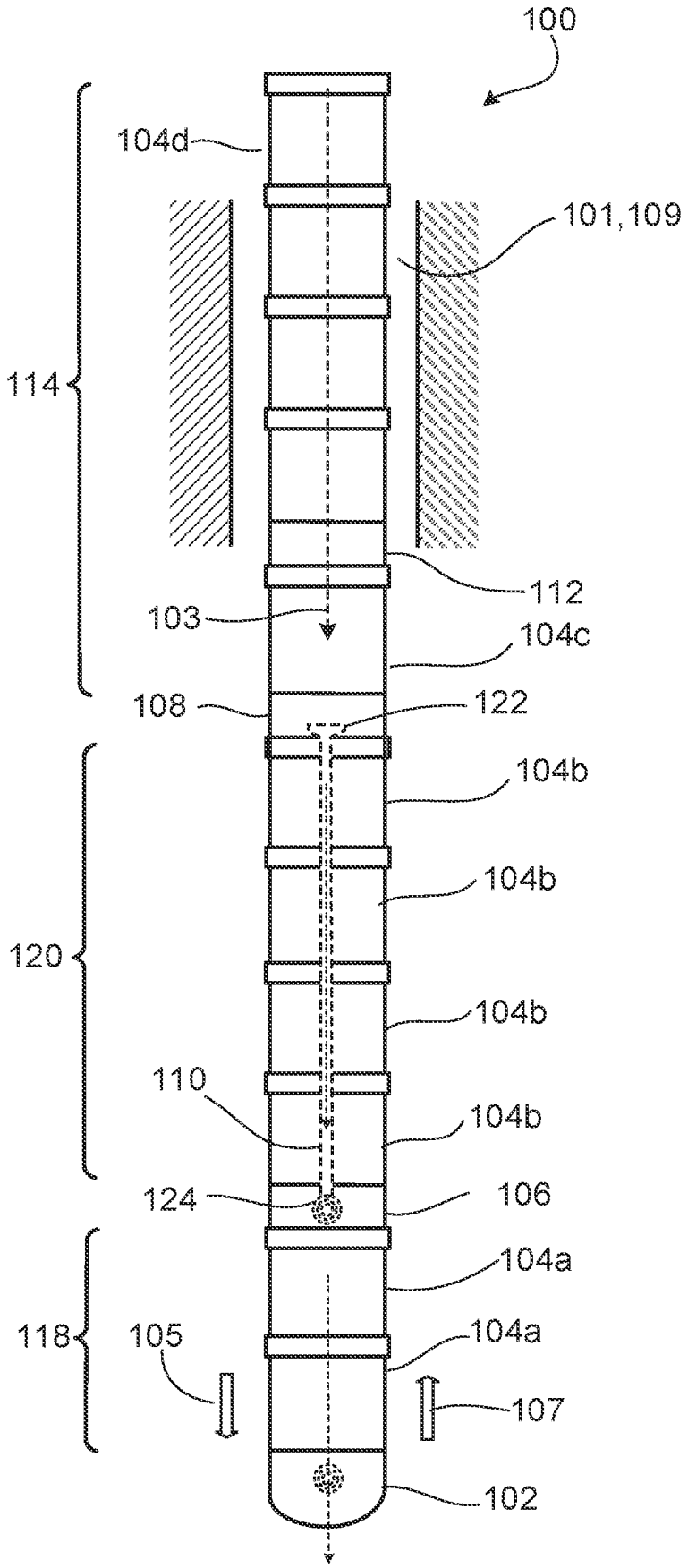
FIG. 1 is a side view of a casing string.

FIG. 1 illustrates an example casing string 100 that is designed to permit circulation of drilling mud 103 through the casing string 100 while the casing system 100 is run into a shallow horizontal well 101. The casing string 100 includes a float shoe 102 at a downhole end, two casing joints 104*a* arranged adjacent the float shoe 102, a float collar 106, multiple casing joints 104*b*, a chamber collar 108, an inner string 110 that extends from the chamber collar 108 to the float collar 106 within the air chamber 120, a casing joint 104*c*, a landing collar 112, and multiple casing joints 104*d* that are sequentially arranged up to the surface. In some embodiments, the casing string 100 has a fully deployed length of about 1,600 meters (m) to about 8,500 m. In some examples, the length of the casing string 100 may vary depending on the directional trajectory and bottom hole targets.

The float shoe 102 is a leading joint with a rounded shape that facilitates running into the well 101 at a downhole end 116 of the casing string 100. The float shoe 102 includes an internal check valve that permits fluid to flow out of the casing string 100 (for example, in a downhole direction 105) and prevents fluid from flowing into the casing string 100 (for example, in an uphole direction 107). The landing collar 112 includes internal components for landing cement plugs during a cementing operation and also allows fluid flow-through. The casing joints 104 (104*a*, 104*b*, 104*c*, 104*d*) are substantially identical tubular sections (for example, cylindrical sections) that provide the majority of the length of the casing string 100. The casing joints 104 are typically made of steel. In some embodiments, each casing joint 104 has an axial length of about 12.0 m to about 12.8 m and a wall thickness of about 1.8 centimeters (cm) to about 1.1 cm. In some embodiments, the casing joints 104 have an outer diameter (for example, defining an outer diameter of the casing string 100) of about 17.7 cm to about 24.4 cm. In some examples, the diameter of the casing string 100 (for example, which will be floated) may depend on the directional trajectory and well casing design.

The casing joints 104*b* together define an air chamber 120 that is fluidically isolated from the remainder of the casing string 100 and from an annulus 109 that surrounds the casing string 100. For example, the air chamber 120 is sealed at a downhole end by the float collar 106 and sealed at an uphole end by the chamber collar 108. Therefore, the casing joints 104*d*, 104*c* and the landing collar 112 define a channel 114 into which drilling mud 103 can flow up until the location of the chamber collar 108. Relative to the channel 114 (for example, which carries drilling mud 103), the air chamber 120 provides a relatively reduced-weight section of the casing string 100 near the downhole end 116 that is not filled with drilling mud 103. The reduced weight of the air chamber 120 provides buoyancy that facilitates advancement of the casing string 100 in the downhole direction 105 through drilling mud 103 in the well 101.

The inner string 110 is a relatively narrow tube that passes through the air chamber 120 to complete a fluid path along which drilling mud 103 can flow from the channel 114 to a channel 118 provided by the casing joints 104*a*. An uphole end 122 of the inner string 110 is fluidically coupled to the channel 114 at the chamber collar 108. That is, the inner string 110 is hung at the chamber collar 108. A downhole end 124 (for example, a stinger) of the inner string 110 is fluidically coupled to the channel 118 at the float collar 106 (for example, a stab-in collar). Thus, the inner string 110 allows drilling mud 103 to flow through the entire casing string 100 and circulate in the uphole direction 107 through the annulus 109 without the air chamber 120 being filled with drilling mud 103. Therefore, the relatively reduced weight of the casing string 100 at the air chamber 120 is maintained, even while drilling mud 103 is able to circulate through the casing string 100.

In some embodiments, the inner string 110 is made of fiber glass such that the inner string 110 is chemically resistant to drilling mud and other downhole fluids. In other embodiments, the inner string 110 may be made of any drillable material that may be drilled with a drilling bit. In some embodiments, the inner string 110 has a burst rating of about 3.5 megapascals (MPa) to about 24.1 MPa (for example, about 20 MPa). In some embodiments, the burst rating may be determined after the size of the inner string is selected according to operational conditions. In some embodiments, the inner string 110 has an outer diameter of about 7.3 cm to about 8.9 cm (for example, about 7.62 cm) such that the inner string 110 is about 2.7 times to 3.3 times smaller than the casing joints 104 in outer diameter. In some embodiments, the inner string 110 has a wall thickness of about 0.5 cm to about 0.8 cm. In some embodiments, the inner string 110 and the air chamber 120 have an axial length of about 305 m to about 3,000 m. The axial length may be determined via simulations that take into account a profile of the well 101 and a length of any horizontal sections of the well 101.

In operation at a horizontal or highly deviated well 101, the components of the casing string 100 are sequentially mated and run into the well 101. For example, the float shoe 102, the casing joints 104*a*, the float collar 106, the casing joints 104*b*, and the chamber collar 108 are mated and advanced into the well 101 without any drilling mud 103 within the casing string 100 at this stage. With the air chamber 120 formed by the casing joints 104*b*, the inner string 110 is deployed to the casing string 100 using a false rotary table at the surface and installed at the float collar 106 and the chamber collar 108. Once the inner string 110 is installed, the casing joint 104*c*, the landing collar 112, and the remaining casing joints 104*d* are sequentially mated to the casing string 100 as the casing string 100 is further advanced in the well 101 while drilling mud 103 is flowed into the casing string 100. The series of casing joints 104*d* will extend to the surface such that the total number of casing joints 104*d* is determined by an axial location of the bottom of the well 101.

The inner string 110 diverts drilling mud 103 from the channel 114 to the channel 118 without compromising the sealed air chamber 120 to provide a complete circuit along which drilling mud 103 can flow through the casing string 110. Therefore, drilling mud 103 can be circulated through the casing string 100 at any axial location while being run into the well 101 to clear (for example, wash down) a nearby obstruction in the well 101 without jeopardizing floatation of the casing string 100 (for example, by minimizing a hydraulic impact of the casing string 100 on the well 100). Importantly, circulation of the drilling mud 103 can also break up (for example, condition) the drilling mud 103 and accordingly limit the gel strength of the drilling mud 103 within the annulus 109. Circulating drilling mud 103 before the casing string 100 reaches the bottom-hole end of the well 101 advantageously prevents a scenario in which the gel strength of the drilling mud 103 at the bottom-hole end has increased to such a high level that the formation is vulnerable to fracture once circulation of the drilling mud 103 would finally commence for the first time at the bottom-hole end, as is the case for conventional casing strings that do not have a mechanism for circumventing an air chamber (for example, for circulating mud past or through an air chamber). Owing to the configuration of the inner string 110 within the air pocket 120, the casing string 100 is especially equipped to be deployed in deviated or horizontal sections in wells with shallow true vertical depth (TVD).

Once the casing string 100 reaches the bottom-hole end and drilling mud 103 is further circulated through the casing string 100 to condition the surrounding drilling mud 103, a cement operation is performed in which cement is pumped down into and through the casing string 100 to the annulus 109, where the cement is allowed to harden. After the cement job is performed, a bottom hole assembly (BHA) is run into the casing string 100 to clean the various casing components of any leftover cement and to mill the fiber glass inner string 100 to ready the casing string 100 for a next section of the well 101.

Figure 2:
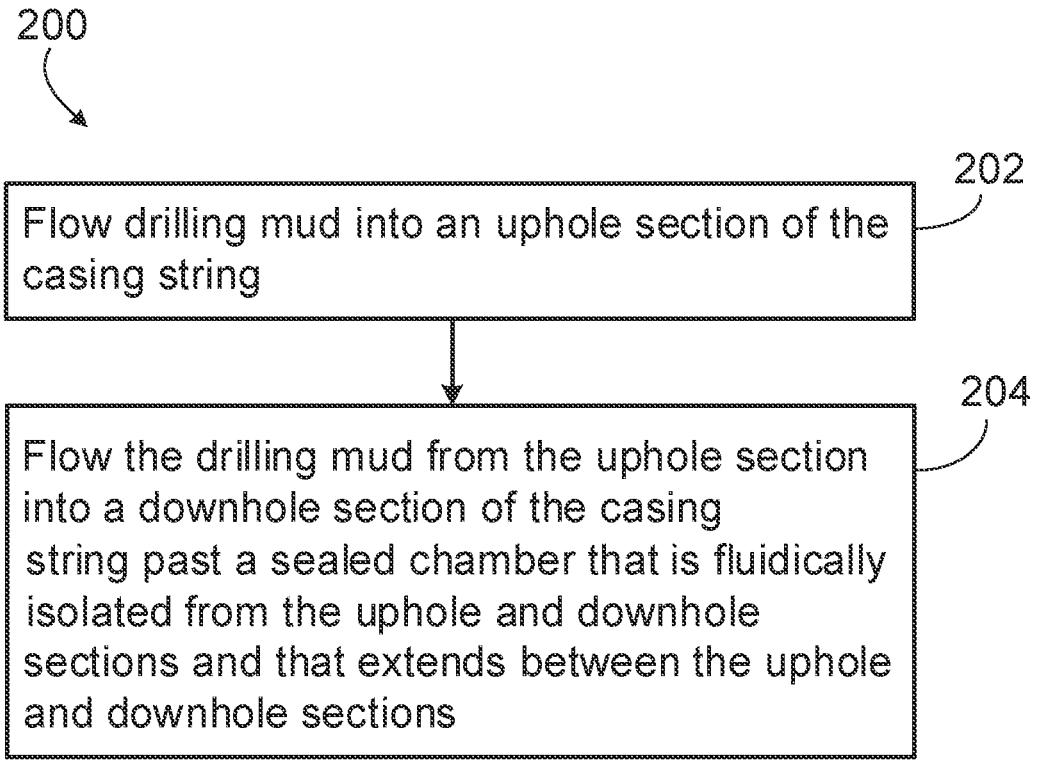
FIG. 2 is a flow chart illustrating an example method of deploying the casing string of FIG. 1 in a well.

FIG. 2 is a flow chart illustrating an example method 200 of deploying a casing string (for example, the casing string 100) within a well (for example, the well 101). In some embodiments, the method 200 includes a step 202 for flowing drilling mud (for example, the drilling mud 103)

into an uphole section of the casing string. In some embodiments, the method 200 further includes a step 204 for flowing the drilling mud from the uphole section into a downhole section of the casing string past a sealed chamber (for example, the air chamber 120) that is fluidically isolated from the uphole and downhole sections and that extends between the uphole and downhole sections.

While the casing string 100 has been described and illustrated with respect to certain dimensions, sizes, shapes, arrangements, materials, and methods 200, in some embodiments, a casing string that is otherwise substantially similar in construction and function to the casing string 100 may include one or more different dimensions, sizes, shapes, arrangements, configurations, and materials or may be utilized according to different methods. For example, while the chamber 120 has been described as an air chamber, in some embodiments, the chamber 120 may be filled with a different fluid other than air, but that is also less dense than drilling mud 103, such that the chamber 120 still provides a lightweight section relative to the remaining sections of the casing string 100 that are filled with drilling mud 103. In some embodiments, the casing string 100 includes a different number of casing joints 104 than what are shown in FIG. 1.

Accordingly, other embodiments are also within the scope of the following claims.

What is claimed is:

1. A casing string comprising:

an uphole section comprising a plurality of uphole casing joints and a chamber collar;

a downhole section comprising a plurality of downhole casing joints and a float collar;

a sealed chamber that is fluidically isolated from the uphole and downhole sections and that extends between the chamber collar of the uphole section and the float collar of the downhole section such that the chamber collar defines an uphole end of the sealed chamber; and a tube that is disposed within the sealed chamber and that fluidically connects the uphole and downhole sections to provide a fluid flow path that extends past the sealed chamber and through the casing string, wherein an uphole end of the tube terminates in a fixed hanging configuration at the chamber collar of the uphole section, wherein a downhole end of the tube terminates at the float collar of the downhole section, wherein the tube, extending in the fixed hanging configuration between the chamber collar and the float collar, defines a fixed length of the sealed chamber, and wherein the sealed chamber comprises a plurality of intermediate casing joints that together extend the fixed length of the sealed chamber between the chamber collar and the float collar.

2. The casing string of claim 1, wherein the tube is made of fiber glass such that the tube is chemically resistant to drilling mud passing therethrough, and wherein the tube has a burst rating in a range of about 3.5 MPa to about 24.1 MPa such that the tube resists a pressure of drilling mud passing therethrough.

3. The casing string of claim 2, wherein the casing string is configured to permit filling of the uphole and downhole sections with drilling mud.

4. The casing string of claim 3, wherein the sealed chamber comprises a fluid that is less dense than drilling mud.

5. The casing string of claim 3, wherein the sealed chamber comprises air.

6. The casing string of claim 1, wherein the tube comprises a stinger, and wherein the float collar is a stab-in float collar.

7. The casing string of claim 1, wherein the downhole section further comprises a float shoe.

8. The casing string of claim 1, wherein an outer diameter of the tube is about 2.7 to 3.3 times smaller than an outer diameter of the plurality of uphole and downhole casing joints.

9. A method of deploying a casing string within a well, the method comprising:

flowing drilling mud into an uphole section of the casing string, the uphole section comprising a plurality of uphole casing joints and a chamber collar; and flowing the drilling mud from the uphole section into a downhole section of the casing string, the downhole section comprising a plurality of downhole casing joints and a float collar, the drilling mud flowing past a sealed chamber that is fluidically isolated from the uphole and downhole sections and that extends between the chamber collar of the uphole section and the float collar of the downhole section such that the chamber collar defines an uphole end of the sealed chamber, and the drilling mud flowing through a tube that is disposed within the sealed chamber and that fluidically connects the uphole and downhole sections, wherein an uphole end of the tube terminates in a fixed hanging configuration at the chamber collar of the uphole section, wherein a downhole end of the tube terminates at the float collar of the downhole section, wherein the tube, extending in the fixed hanging configuration between the chamber collar and the float collar, defines a fixed length of the sealed chamber, and wherein the sealed chamber comprises a plurality of intermediate casing joints that together extend the fixed length of the sealed chamber between the chamber collar and the float collar.

10. The method of claim 9, further comprising:

flowing the drilling mud out of the casing string; and circulating the drilling mud through an annulus disposed between the casing string and the well.

11. The method of claim 9, wherein the tube is made of fiber glass such that the tube is chemically resistant to drilling mud passing therethrough, and wherein the tube has a burst rating in a range of about 3.5 MPa to about 24.1 MPa such that the tube resists a pressure of drilling mud passing therethrough.

12. The method of claim 9, further comprising installing the tube to the casing string to fluidically connect the uphole and downhole sections after forming the sealed chamber.

13. The method of claim 9, wherein the sealed chamber comprises a fluid that is less dense than drilling mud.

14. The method of claim 13 wherein the sealed chamber comprises air.

15. The method of claim 14, wherein the well comprises a substantially horizontal section, and wherein the method further comprises floating the casing string within the horizontal section of the well.

16. The method of claim 9, wherein an outer diameter of the tube is about 2.7 to 3.3 times smaller than an outer diameter of the plurality of uphole and downhole casing joints.

* * * * *